US005632416A

United States Patent [19]

Lane, Jr. et al.

[11] Patent Number: 5,632,416

[45] Date of Patent: May 27, 1997

[54] COLLAPSIBLE DISPENSER POUCH

[75] Inventors: William A. Lane, Jr., Lake Arrowhead; Steven D. Davis, Yuciappa, both of Calif.

[73] Assignee: W. A. Lane, Inc., San Bernardino, Calif.

[21] Appl. No.: 10,766

[22] Filed: Jan. 29, 1993

[51] Int. Cl.[6] ..... B65D 35/56

[52] U.S. Cl. ..... 222/105; 222/107; 222/541.6

[58] Field of Search ..... 222/95, 105, 107, 222/541.6, 325

[56] References Cited

U.S. PATENT DOCUMENTS

| | | | |
|---|---|---|---|
| 3,278,085 | 10/1966 | Brown | 222/107 |
| 3,913,769 | 10/1975 | Miller | 206/484 |
| 4,007,838 | 2/1977 | Awad | 206/484 |
| 4,227,614 | 10/1980 | Hollander, Jr. | 426/115 |
| 4,645,098 | 2/1987 | Hoffman | 222/386 |
| 4,768,330 | 9/1988 | Lane, Jr. et al. | 53/554 |
| 4,797,309 | 1/1989 | Kammerer et al. | 222/541 |
| 4,845,926 | 7/1989 | Davis | 53/45.1 |
| 4,872,556 | 10/1989 | Farmer | 222/107 |
| 4,932,562 | 6/1990 | Christine | 222/96 |
| 5,150,820 | 9/1992 | McGill | 222/95 |
| 5,156,305 | 10/1992 | Eyre | 222/327 |
| 5,242,083 | 9/1993 | Christine et al. | 22/105 |

FOREIGN PATENT DOCUMENTS

| | | | |
|---|---|---|---|
| 78761 | 5/1983 | European Pat. Off. | 222/107 |
| 229913 | 2/1944 | Switzerland . | |
| 264673 | 6/1970 | U.S.S.R. . | |
| 2186544 | 8/1987 | United Kingdom . | |

*Primary Examiner*—Philippe Derakshani
*Attorney, Agent, or Firm*—James G. O'Neill

[57] ABSTRACT

A pouch for holding viscous food product for dispensing from a specific hand held or similar type dispenser, is formed so as to include a tear strip to open a funnel-shaped, centrally disposed outlet spout formed to be sealingly held in the specific dispenser. The pouch includes a pair of alignment/holding openings formed on either side of the outlet spout for securing the pouch in a fixed position in the dispenser. The invention also includes head seal tooling having a pair of heated jaws which are brought together to simultaneously form the bottom seal of a top unfilled, pouch and the outlet spout and angularly disposed top seals of a filled lower pouch, while at the same time forming perforations for the tear strip, the pair of openings in the lower pouch and cutting-off the formed, filled and sealed lower pouch from the upper pouch.

13 Claims, 4 Drawing Sheets

COLLAPSIBLE DISPENSER POUCH

BACKGROUND OF THE INVENTION

1. Field of the Invention

This invention relates generally to pouches for holding liquified or pulverized products, and more particularly, to an improved collapsible, sanitary pouch for use in shipping, storing and dispensing food products, as well as the tooling to make such pouches.

2. Description of Related Art

Because of the technical advances in film pouch forming, filling and sealing machines, more and more food and related products, in various states, are being packaged in flexible film pouches for dispensing of such products. Known machines to form, fill and seal such pouches utilize continuous rolls of film. Pouches are formed from the rolls of film, filled with product and then sealed in a continuous process.

To form pouches on these known form, fill and seal packaging machines, side seals are normally formed between front and back films by side seal forming means and a cross seal forming means is then utilized to form the bottom seal. This three-sided pouch is then filled with product and the machine indexed to forward the filled pouch. The same cross seal forming means is then utilized to form the top seam on this filled pouch. At the same time, it forms the bottom seam on the next partially formed, but still empty pouch. The formed pouch is then severed from the moving streams of front and back heat sealable films and is discharged from the machine. The machine is indexed and the cycle then continued.

The side seams or side seals of the pouch are formed at one station by side seat forming means, while the cross seams or cross seals are formed by a head seal containing opposing front and back seal bars which come together to join front and back rolls of material by pressure and heat. The combination of heat and pressure at both stations form cross and side seals between the films to create the various pouch seams. Examples of such machines are disclosed in U.S. Pat. No. 4,768,330 ("'330"), assigned to W. A. Lane, Inc. of San Bernardino, Calif., the assignee of the present invention. The disclosure of this patent is incorporated herein, in its entirety, by this reference thereto. Further such machines are disclosed in U.S. Pat. No. 4,845,926, also assigned to W. A. Lane, Inc.

As discussed in the '330 patent, the typical form, fill and seal packaging machine is capable of concurrently forming a linear array of side by side pouches across the width of the machine. The number of side by side pouches concurrently formed can vary form a single pouch, when large, wide pouches are being formed, up to a large number of narrow pouches, depending on the limits of the machine size and material(s) being used. The cross sealing means and separate cut-off or severing means to form such pouches must extend across the width of the material being formed, filled and sealed in the machine.

The final size of a pouch formed on a pouch packaging machine is usually determined by the amount and type of contents to be held in the pouch and how the contents will be dispensed from the pouch. Thus, the geometry of a pouch is highly dependent upon what the pouch will ultimately contain as well as how and where its contents is to be dispensed.

Some specifically designed smaller pouches or containers are known for use in hand held and other devices for dispensing viscous food products. These known pouches and dispensing means have numerous drawbacks or problems, including, but not limited to, cost of labor to produce and/or use, packaging expense, portion control, sanitation, speed of dispensing and waste generation. Furthermore, such known pouches or containers usually have integral fitments or valving mechanisms that must be somehow operated or opened by the dispensing means to dispense the items contained therein.

With the current global concerns over environmental and safety issues, such as, sanitation in the delivery, storage and handling of food products, the need to cut down on solid waste and the need to save energy, large sanitary pouches offer a simple and elegant solution to many of these concerns. Therefore, there exists a need in the packaging and dispensing art for a relatively large, collapsible, sanitary dispensing pouch for use in holding and dispensing viscous food products from hand held or similar type dispensing means, which pouch overcomes the above set forth drawbacks and which can be easily manufactured and filled in existing machinery by use of specific tooling in accordance with the present invention.

SUMMARY OF THE INVENTION

Accordingly, it is a general object of the present invention to provide an improved collapsible, sanitary dispensing pouch. It is a more particular object of the present invention to provide a collapsible dispensing pouch for use in a hand held or similar type dispenser. It is a further object of the present invention to provide a novel collapsible dispensing pouch that is formed by a novel head seal means. It is yet another object of the present invention to provide a novel collapsible dispensing pouch without an integral fitment, and which contains a relatively large amount of viscous food product for accurate, controlled dispensing from a hand held or similar type dispenser. It is a still further object of the present invention to provide novel head seal means to simultaneously form a plurality of specifically configured pouches for use in a dispenser.

In accordance with the present invention there is provided a novel collapsible pouch having a tear-off portion adjacent a specifically formed outlet spout adapted to be sealingly held in a dispenser. The pouch includes a pair of openings formed adjacent the outlet spout and below the tear-off portion for aligning and securing the pouch in a fixed position in a dispenser. The invention also comprises a novel head seal adapted for use in known form, fill and sealing machines for forming a plurality of such pouches. The head seal includes a pair of heated jaws which are brought together to form the bottom seal of a top unfilled pouch and the cross or top of a filled lower pouch, while at the same time, forming perforations for the tear-off portion, the pair of alignment openings in the lower pouch and cutting off the formed lower pouch from the upper pouch.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for a novel collapsible, sanitary dispenser pouch of relatively large size, and head seal tooling to simultaneously form top and bottom cross seals for a plurality of such pouches, as well as a perforated tear-off portion and a pair of alignment openings in selected pouches, and to cut-off formed and filled pouches from moving streams of front and back head sealable films from which the pouches are formed.

Figure 1:
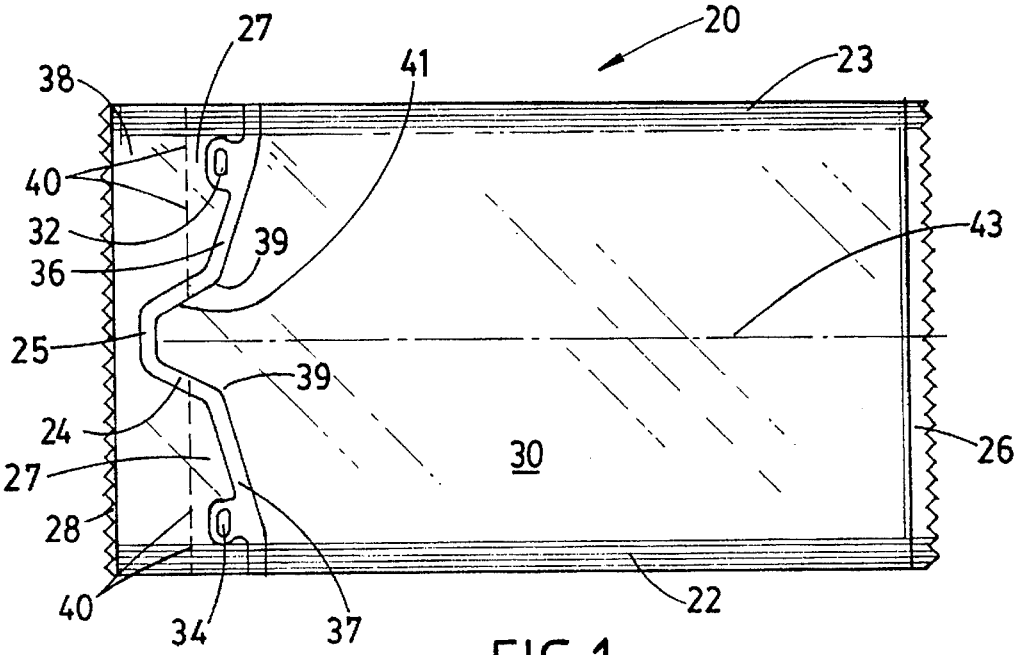
FIG. 1 is a front elevational view of a formed, filled and sealed collapsible dispensing pouch in accordance with the present invention.
Figure 2:
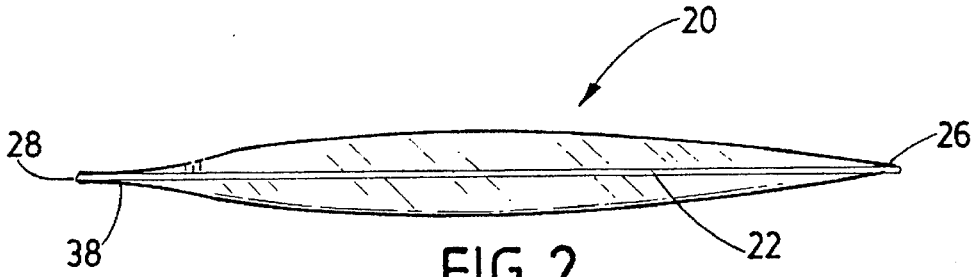
FIG. 2 is a side elevational view of the pouch of FIG. 1.
Figure 3:
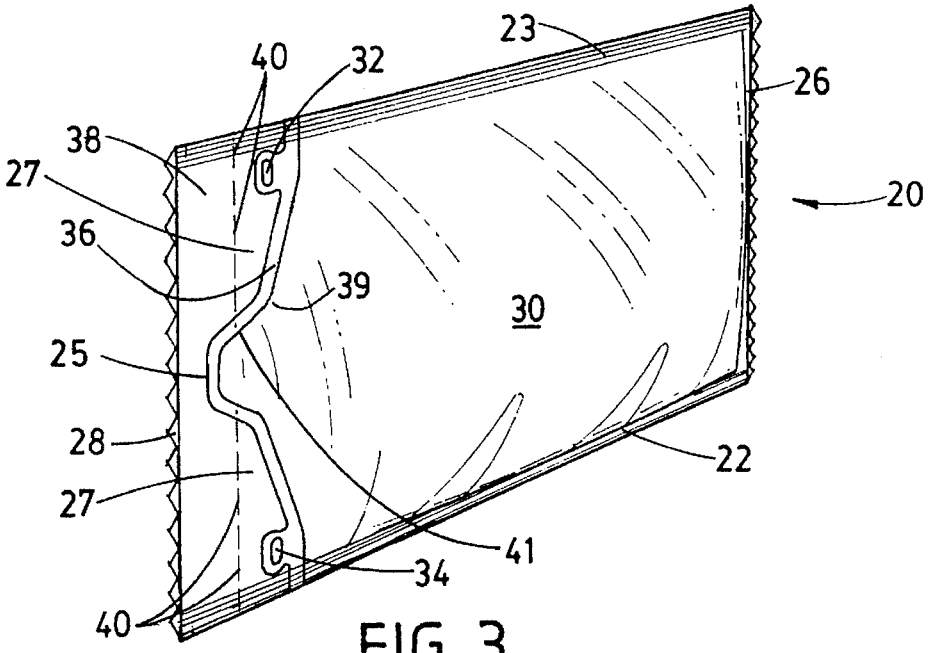
FIG. 3 is a perspective view of the pouch of FIG. 1.

Turning first to FIGS. 1–3, there shown is a novel collapsible, sanitary dispenser pouch 20 formed in accordance with the present invention. The pouch 20 has a pair of side seals 22, 23 formed thereon, in a known manner, as in available form, fill and seal machines from W. A. Lane, Inc., the assignee of the present invention. The pouch 20 includes a centrally disposed outlet spout 24, having a tear-off opening or tip 25, described more fully below, formed in a cross seal at the outlet, top or upper end 28 thereof, between the side seals 22, 23. Additionally, the pouch 20 includes a bottom or lower cross or end seal 26 and at least one top or upper cross seal. As shown in FIGS. 1 and 2, a first or single top cross seal means may be formed by the sealed edge of spout 24 and further angularly descending seal means or wall portions 36 and 37, described below. If desired, a further top, upper or outlet end cross seal may be provided at the furthest point on the outlet end 28, immediately above the cross seal means containing the outlet spout 24.

An inner chamber 30, is formed in the pouch 20, between the side seals 22 and 23, bottom cross seal 26, and the first cross seal means formed by the centrally disposed outlet spout 24 and the angular seal means 36 and 37. A relatively large amount of viscous food product, such as the 24 to 30 fluid ounces (71 to 89 cl) discussed below, is placed in and sealingly held in this chamber 30, for dispensing through the opening formed in the centrally disposed outlet spout 24, when the pouch is held in a dispenser and the end or tip 25 opened or removed, as described below. A pair of alignment/holding openings 32, 34, are formed extending entirely through both sheets of head sealed film forming the pouch 20, adjacent the angular seal means 36 and 37, in a substantially flat area 27, on either side of the sealed outlet spout 24, outside or away from the interior chamber 30, adjacent the side seals 22, 23, and below a tear-off strip 38, described below. These alignment/holding openings 32, 34 are accurately formed in predetermined positions, to hold the filled pouch in a dispensing means, as disclosed more fully below.

The angular seal means or wall portions 36 and 37 are preferably formed as portions of the first cross seal means and as shown in FIG. 1, extend from the side seals 22 and 23 to the outlet spout 24, at a specific angle, such as approximately 15 degrees from parallel to the outlet end 28 and bottom seal 26, both of which are substantially straight and perpendicular to the side edge seals 22, 23. It, therefore, can be seen that the seal means 36 and 37 form angled or sloping end walls or sealed portions that extend between the side seals 22, 23 and the outlet spout 24. The openings 32 and 34 allow a filled pouch 20 to be properly positioned in specific hand held or similar type dispensers, so as to be aligned and fixed, or held in place by pin means, or the like, (not shown) passing through the openings 32, 34. With the pouch so fixed or held in place, the contents of the pouch may be accurately and fully dispensed from the dispenser through the outlet spout 24, when the spout 24 is opened, as described below. That is, the contents of the collapsing pouch are directed to the outlet spout 24 by the angular sealed or wall portions 36 and 37, around curved or rounded edges 39 and down or through a funnel shaped or sloped internal surface or opening 41 within the spout 24. This internal surface 41 preferably slopes at an angle of approximately 30 degrees from the centerline 43 of the pouch, as shown in FIG. 1.

Any dispenser for use with the collapsible pouch of the present invention should preferably include a valve or closure means positioned to cooperate with the outlet spout, so as to open and close the outlet spout 24 of the pouch, after the pouch is placed in the dispensers and the tear strip 36 removed to remove the tip 25. The dispenser should also include an operating means, such as a piston type plunger, a squeegee type means, or other known or to be discovered means to dispense the contents from the pouch, in desired portions. As states above, the angular or descending walls or sealed portions 36 and 37 of the chamber 30, together with the contour, position and shape of the interior chamber 30 of the pouch 20, and the internal shape 41 and size of the opening of spout 24 ensures proper flow, by eliminating any areas or corners where product could be held, or product flow could be interrupted or disturbed. In this manner, substantially all of the viscous product in the collapsible pouch may be evenly dispensed, in predetermined increments, from the internal chamber 30 through the centrally disposed outlet spout 24, by the operating means of the dispenser in which it is held.

The pouch 20 must be made from material which will remain sanitary and is sufficiently flexible to enable the pouch to be collapsed by the various operating means, so as to substantially completely empty the contents therefrom, as described above. Such materials are now readily available and used in the food industry. Furthermore, although the pouch may be formed in various sizes and shapes, it is preferably formed so as to be substantially rectangular in shape in the x-y dimensions, as shown in FIGS. 1–3, and substantially elliptical (when filled) with narrowed or pointed ends in the z dimension, as shown in FIG. 3. The following are the preferred dimensions of one embodiment of the invention:

length (x)-approximately twelve (12) inches or 305 mm;
width (y)-approximately six (6) inches or 152.5 mm;
thickness, when full (z)-because of elliptical shape varies, up to approximately one (1) inch or 25.4 mm in the center thereof.

Figure 4:
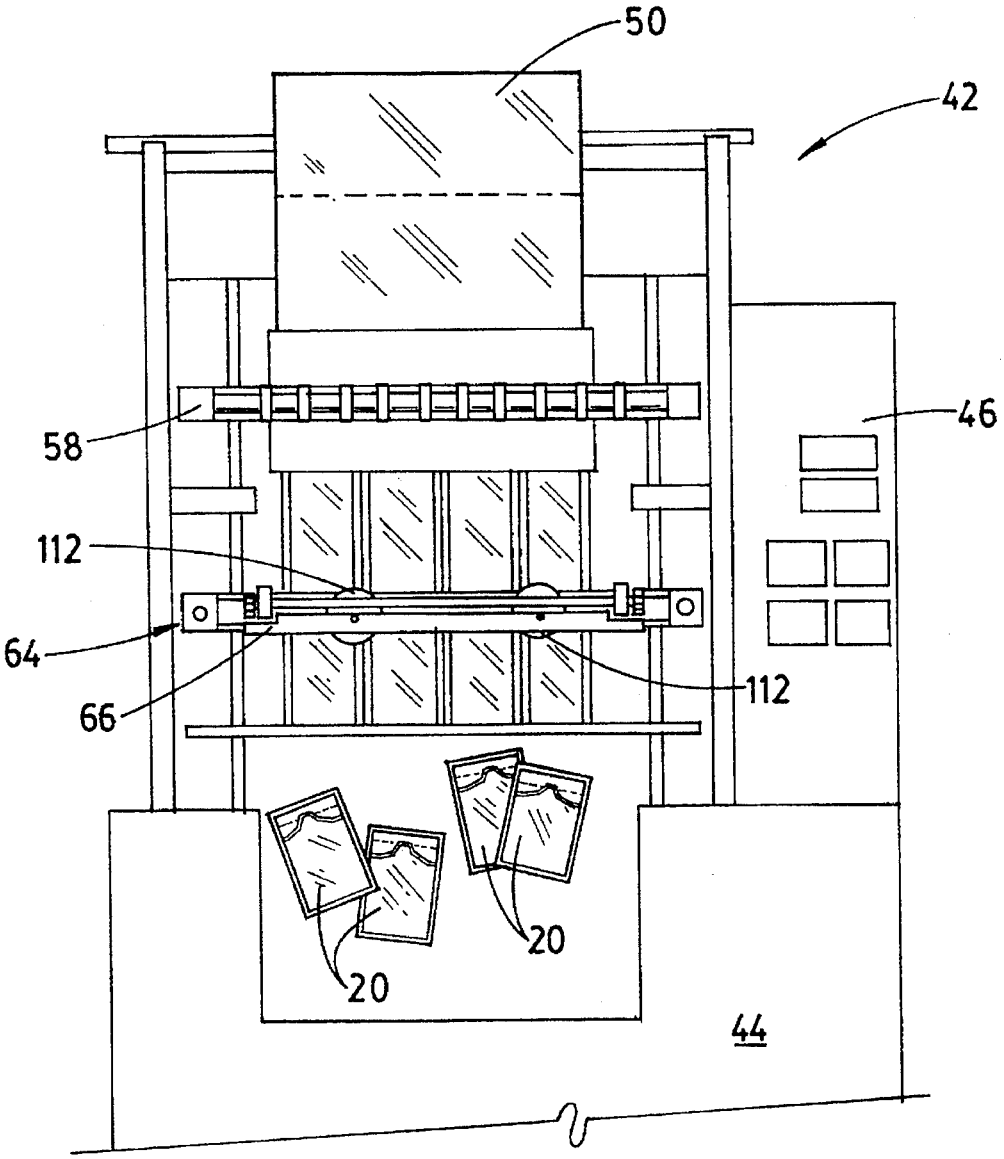
FIG. 4 is a schematic front elevational view of a representational form, fill and seal packaging machine.
Figure 5:
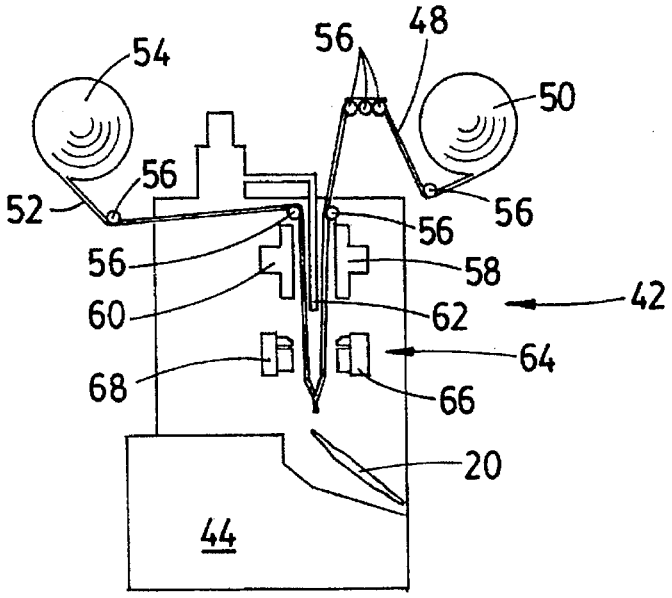
FIG. 5 is a side elevational view of the machine of FIG. 4.

A plurality of pouches 20 are preferably formed in a form, fill and sealing machine, such as shown in FIGS. 4 and 5, utilizing standard size rolls of film, and described below. For example, in a machine using flexible rolls of film having a width of from 12 to 24 inches (305 mm to 610 mm), a number of wider pouches, for example, up to four viscous food pouches having widths of between 5 and 6 inches (127 to 152.5 mm), and any desired length, such as 12 inches or 305 mm, may be simultaneously formed, filled and sealed when using 24 inch (610 mm) film rolls. Such formed pouches preferably contain substantially large amounts of viscous food products in a sanitary manner. For example, such a formed pouch could contain from approximately 24 to 30 fluid ounces (71 to 89 cl) of a viscous food product, such as, ketchup, mayonnaise, mustard, sour cream, various sauces, or the like, to be dispensed from a hand held or similar type dispenser by an employee in a fast food restaurant or other environment, where foods are prepared for sale, or at condiment bars or areas for use by a customer. By using a large size pouch for viscous food products, the products may be more easily shipped, stored and dispensed in a sanitary manner. Furthermore, these pouches will replace large numbers of smaller containers or pouches, such as are currently used, thus enabling substantial savings in energy and materials to be achieved, as well as producing less waste. Finally, by utilizing dispensers which are designed to work with the specifically contoured internal angular seal means 36 and 37 and internal sloping wall 41 of opened outlet spout 24 of the pouch, the food product may be more accurately controlled and dispensed, without the need of an expensive fitment or valving means, such as is contained in or formed to known containers or pouches. This in turn, allows the pouch to be more easily handled, while allowing close maintenance and regulation of the sanitation of the viscous product in the pouch.

After being formed, filled and sealed, the pouch 20 may be shipped and stored until ready for use. In normal use, the tip or farther end 25 of outlet spout 24 of pouch 20 is opened or removed by tearing off the tear-off strip 38, formed below the end 28 and above both the openings 32, 34 and the angular seal means 36 and 37 of chamber 30. A plurality of perforations 40 are formed in and extend across the entire outlet end, except across the outlet spout 24, substantially parallel to the substantially straight outlet end 28, to allow the tear-off strip 38 to be removed, in a known manner. When the tear-off strip 38 is removed, the end or tip 25 of outlet 24 is also removed to form an opening to allow the viscous contents of the pouch to be dispensed therethrough. The opened end of spout 24 is preferably controlled by closure means (not shown) in a hand held or similar dispensing means, to regulate the flow of viscous fluid as the pouch 20 is collapsed.

FIGS. 4 and 5 illustrate a typical commercial form, fill and seal pouching machine 42, similar to that disclosed in column 5 of the '330 patent. This machine 42 includes a housing 44, a control unit 46, front heat sealing film 48 on a continuous roll 50, rear heat sealing film 52 on a continuous roll 54, a plurality of tensioning rollers 56, a front side seal bar 58 and a rear side seal bar 60, all of which are similar to and operate in substantially the same manner as the corresponding, but differently numbered, elements in '330.

As more clearly shown in FIG. 5, the front film 48 and rear film 52 are fed between the front and rear seal bars 58 and 60 to form continuous seals or joints between the films, in a known manner. In the machine shown herein, five corresponding front and rear side seal bars are utilized to form the side seals, such as side seals 22 and 23 for four continuous streams of side by side pouches 20. Appropriate cutters, not shown, are utilized in a known manner to sever the continuously formed side seals to form the separate pouches. After formation of bottom seals, as described below, each of the formed pouches is then filled, in a manner known to those skilled in the art, by filling heads 62, contained in the machine 42.

Located below or downstream from the filling heads 62, and replacing the currently available head seal, is a novel head seal means or tooling 64, consisting of front and rear head seal bars or jaws 66 and 68, respectively. A preferred embodiment of the novel head seal tooling 64 is shown in FIGS. 6–12. This head seal means forms the bottom seal 26 and the top cross seals and related components, consisting of the angular seal means 36 and 37, as well as the centrally disposed outlet spout 24, the alignment openings 32 and 34 and the perforations 40 in pouches 20. This head seal also includes means to cut off the formed pouches from the streams of front and rear film, and may include means to form a further outlet end cross seal, adjacent the outlet end 28.

Figure 6:
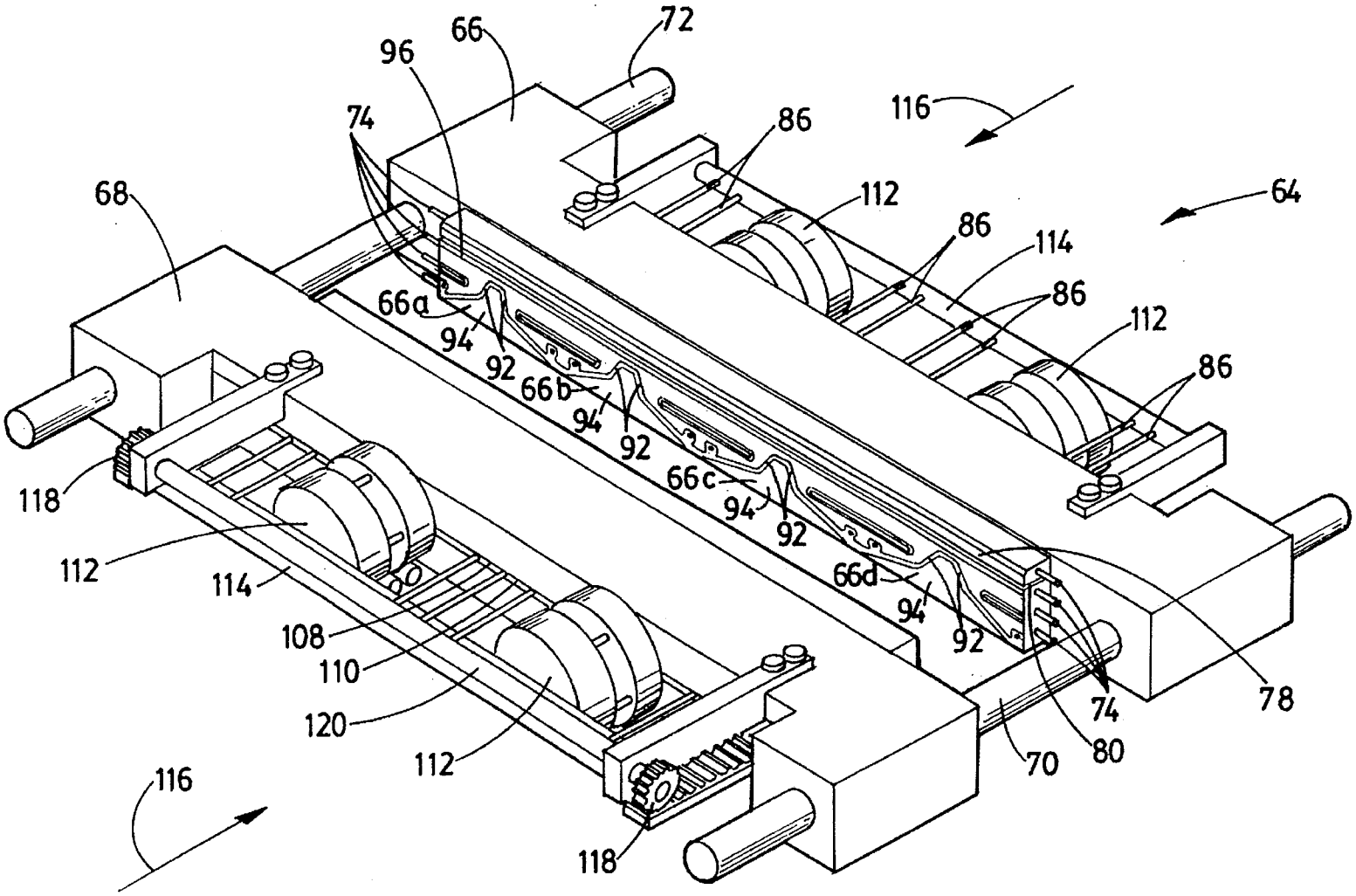
FIG. 6 is a perspective view of the head seal in accordance with the present invention.

Turning now to FIG. 6, there shown are the separate jaws 66 and 68 of the tooling 64 slidably held on a pair of bars 70 and 72, in a known manner, by openings formed at either end of the jaws, to enable the surfaces of the jaws to be brought together, by means (not shown), known to those skilled in the art, to form the cross seals, etc. Each of the movable jaws or heads 66 and 68 is heated by a plurality of elongated pin type heaters 74, extending from both end thereof, and preferably four in number, inserted and held in openings 76 formed in the jaws, as shown more clearly in FIGS. 11 and 12. These heating elements are wired in a manner know to those skilled in the art, and operated by the control unit 46, in a known manner, to heat the jaws 66 and 68 to form the seals in the films, by the combination of this heat, and the pressure of the jaws 66 and 68 when they are brought together.

Figure 8:
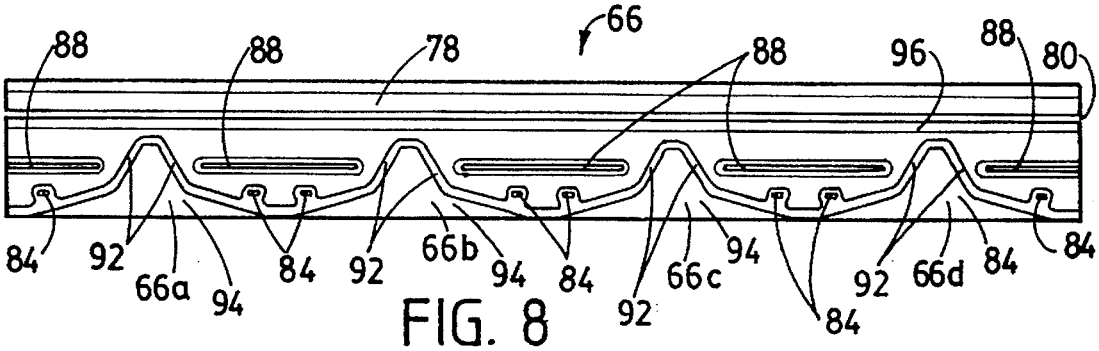
FIG. 8 is a front elevational view of the other jaw of the head seal of FIG. 6.
Figure 9:
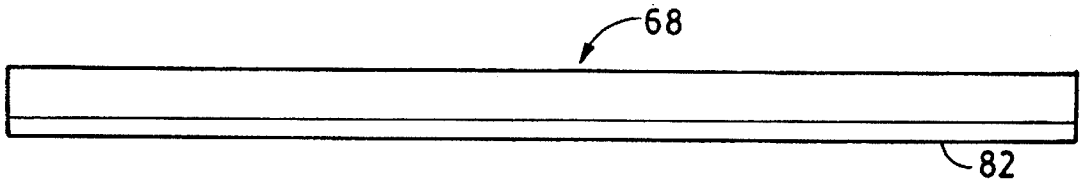
FIG. 9 is a partial top elevational view of the head seal jaw of FIG. 7.
Figure 10:
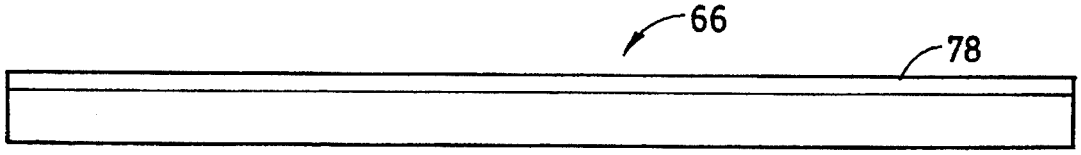
FIG. 10 is a partial top elevational view of the head seal jaw of FIG. 8.
Figure 11:
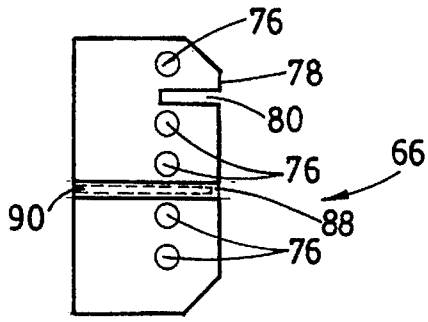
FIG. 11 is a partial end view of the head seal jaw of FIG. 8.
Figure 12:
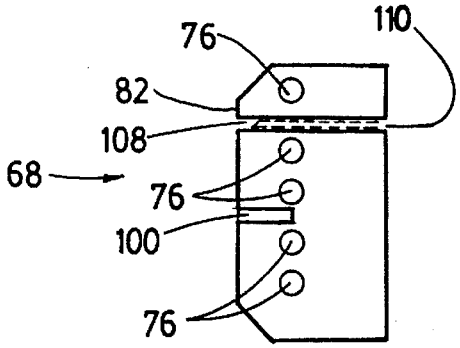
FIG. 12 is a partial end view of the head seal jaw of FIG. 7.

As illustrated in FIGS. 6 and 8, the front surface of the jaw 66, is shown, for example only, end not by way of limitation, as including four pouch forming areas, marked as **66*a*, 66*b*, 66*c* and 66*d*, to form four separate pouches at a time, when they are brought into con(act with four corresponding areas 68*a*, 68*b*, 68*c* and 68*d* on the front surface of jaw 68. Above these areas 66*a–d* are a cross seal portion 78, and a cut-off receiving area or depression 80, each of which extend along the entire face thereof. The cross seal portion 78 coasts with a corresponding cross seal portion 82 extending across the entire front face of jaw 68 to form the bottom seal 26 of a top, partially formed pouch (side seals only), when the jaws 66 and 68** are brought together, before filling and completion of the top pouch, as described more fully below.

Each of the areas **66*a–d* on the front surface of jaw 66 includes the following elements to form the top cross seal having outlet spout 24 and angular seal means 36 and 37, openings 32 and 34, the perforations 40, and, if desired, a further top cross seal adjacent end 28, in a completed and filled pouch 20: a pair of openings 84 through which a pair of punches 86 (see FIG. 6) are reciprocated to form the openings 32 and 34 in the pouch; slotted openings 88 through which a multi-bladed perforator 90 slides to form the perforations 40; a raised, substantially funnel or hat-shaped, combination outlet and angular seal means forming surface 92, surrounding an insulated area 94; and if a further top cross seal is desired adjacent end 28, a further raised seal forming area 96, which preferably extends entirely across the face or front surface of jaw 66**.

Figure 7:
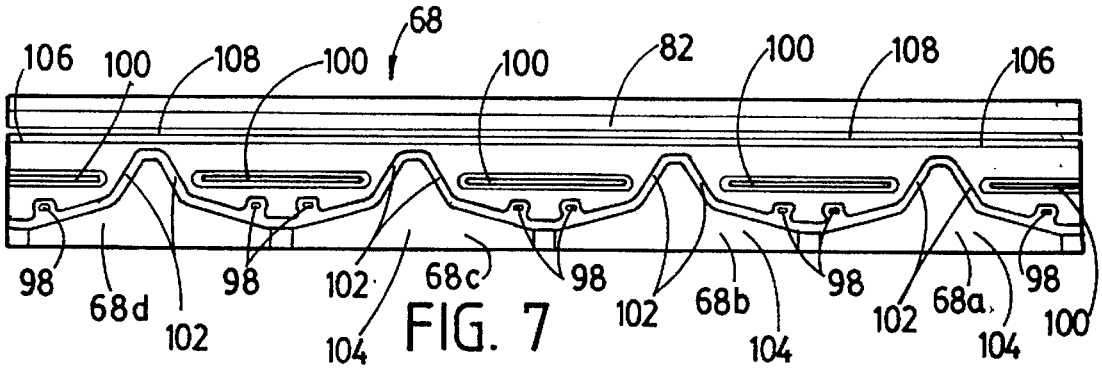
FIG. 7 is a front elevational view of one of the jaws of the head seal of FIG. 6.

As shown in FIG. 7, each of the corresponding areas 68*a–d* on the front surface of jaw 68 includes the following elements which cooperate with the respective or corresponding elements on the front surface of jaw 66 to enable the tooling 64 to form the outlet spout 24, angular seal means 36 and 37, openings 32 and 34, the perforations 40, to cut-off a completed filled and sealed pouch 20, and if used, to form the further top cross seal: a pair of recessed holes 98 to receive the ends of the plurality of punches 86 when they are reciprocated to form the openings 32 and 34, after they pass through the sheets of film; slotted recesses 100 to receive the ends of the perforator blades 90, when the blades form the perforations 40; a raised complementary surface 102, surrounding an insulated area 104, against which the raised, funnel or hat-shaped, combination outlet spout forming and angular seal means forming surface 92 of the front surface of jaw 66 presses the front and rear films film, and, if the further top cross seal is to be added and the further raised seal forming area 96 is located on each of the areas 66*a–d* on front jaw 66, a further flat surface 106 against which the further raised seal forming area 96 presses the front and rear films. Furthermore, an elongated opening 108 is formed through the jaw 68, across from and cooperating with the recess 80 formed in the jaw 66. A cut-off means 110, such as a cut-off blade (se FIG. 12), reciprocates in opening 108 to cut-off formed pouches 20 when the cut-off blade passes through the front and rear films into recess 80.

During operation of the head seal, the jaws 66 and 68 are first brought together to form the various seals by heat and pressure. Then, the punches 86, perforation blades 90 and cut-off blade 110, are operated, preferably as follows: operating means 112, such as a plurality of pistons, as shown in FIGS. 4 and 6 are actuated, in any known manner, such as by means of a compressed fluid fed to the interior thereof to move the internal pistons. The operating means 112 is preferably directly connected to a bar or strongback 114, to move the strongback, in the direction of the arrow 116, toward the front or forward surface, of each of the jaws 66 and 68. This movement of the bars 114 is controlled by rack and pinion means 118, connected together, at both ends of each jaw 66 and 68, by a rod 120, and simultaneously moves the punches 86, perforation blades 90 and cut-off blade 110, attached to the respective bars, to perform the required actions, as described above.

It, therefore, can be seen that the uniquely sized and shaped collapsible dispenser pouch and tooling for making the same of the present invention, provides a novel means for allowing sanitary food and other viscous products to be quickly and easily placed in pouches and sealed therein in such a manner that the pouches are easily handled, stored and used to dispense the product contained therein, in controlled, measured quantities. The product in the pouches are protected from being contaminated in any manner whatsoever, during the shipping, handling, storage and dispensing thereof. Furthermore, by using relatively large size pouches, of a size still usable in a hand held or similar dispenser, substantial savings in energy, materials and time are produced, with less waste generated.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A substantially large collapsible dispenser pouch formed from thin films of sheet material for holding a substantially large amount of viscous food product for dispensing from a dispenser, comprising:

a pair of substantially rectangular heat sealable films having two ends and two sides, heat sealed together along said two sides by substantially straight side seals;

a first of said two ends being heat sealed together so as to form a bottom substantially straight cross seal;

the other of said two ends being heat sealed together so as to form a top cross seal having an outlet spout formed therein;

a hollow internal chamber holding said substantially large amount of viscous food product formed between said substantially straight side seals, said bottom substantially straight cross seal and said top cross seal, and fluidly connected to said outlet spout;

said outlet spout including sloped internal wall portions and being centrally disposed in said top cross seal, between said substantially straight side seals and a pair of alignment openings formed in and passing through said pair of substantially rectangular heat sealable films, on either side of said centrally disposed outlet spout and away from said internal hollow chamber, toward said other of said two ends;

a tear-off strip formed in said other of said two ends away from said internal hollow chamber, above said alignment openings, by a plurality of perforations formed therein and extending substantially across said other of said two ends, up to but not across a tip of said centrally disposed outlet spout;

said sloped internal wall portions of said outlet spout forming a single interior surface which slope toward the tip of said outlet spout to form a funnel-shaped interior area to control the flow of said viscous food product held in said internal hollow chamber through said outlet spout, when said tear strip is removed to remove said tip of said outlet spout and to open said outlet spout; and said top cross seal including sealed portions formed between said pair of substantially rectangular heat sealable films adjacent to and angularly disposed between said sloped internal wall portions of said centrally disposed outlet spout and said substantially straight side seals to form angled walls in said internal hollow chamber, which angled walls serve as a path for said viscous food product held in said internal hollow chamber to be substantially completely dispensed through said sloped internal wall portions of the opened outlet spout.

2. The dispenser pouch of claim 1 wherein said alignment openings are in a flattened area of said dispenser pouch formed above said angled walls and between said outlet spout and said perforations.

3. The dispenser pouch of claim 2 wherein said angled walls are at angles of approximately 15 degrees with respect to said substantially straight side seals.

4. The dispenser pouch of claim 2 wherein said sloped internal wall portions of said outlet spout are sloped at an angle of approximately 30 degrees with respect to a centerline of said dispenser pouch, which centerline is disposed parallel to said substantially straight side seals and passes centrally through said dispenser pouch and said outlet spout, to form said funnel-shaped interior area in said outlet spout.

5. The dispenser pouch of claim 4, further including substantially smooth, rounded edge formed between said angularly disposed sealed portions and said internal surface of said centrally disposed outlet spout.

6. The dispenser pouch of claim 5 wherein said internal hollow chamber of said dispenser pouch carries between 24 and 30 liquid ounces of viscous product.

7. A collapsible, sanitary dispenser pouch formed from thin films of sheet material for holding a substantially large amount of viscous food product, comprising in combination:

a pair of substantially rectangular heat sealable films having two ends and two sides, heat sealed together along said two sides by substantially straight side seals;

a first of said two ends being heat sealed together so as to form a bottom, substantially straight cross seal;

a portion of the other of said two ends being heat sealed together so as to form a top cross seal having a specifically formed sealed outlet spout portion therein;

a hollow internal chamber formed between said substantially straight side seals, said bottom substantially straight cross seal and said top cross seal to hold said substantially large amount of viscous food product therein;

said specifically formed sealed outlet spout portion including sloped internal walls and an outlet tip and being centrally disposed between said substantially straight side seals; said sloped internal walls of said specifically formed sealed outlet spout portion forming a single interior surface which slopes toward said outlet tip to form a funnel-shaped interior area to control the flow of viscous product held in said internal hollow chamber through said specifically formed sealed outlet spout portion;

a pair of openings formed in and passing through said pair of substantially rectangular heat sealable films, spaced from and on either side of said specifically formed sealed outlet spout portion, and away from said hollow internal chamber, toward said other of said two ends;

said top cross seal including sealed portions formed between said pair of substantially rectangular heat sealable films adjacent to and angularly disposed between said sloped internal wall portions of said specifically formed sealed outlet spout portion and said substantially straight side seals to form angled internal walls in said hollow internal chamber; and a tear-off strip formed in said other of said two ends, away from said hollow internal chamber, above said openings, by a plurality of perforations formed therein and extending across said other of said two ends, up to but not across said outlet tip of said specifically formed sealed outlet spout portion, whereby, when said tear-off strip is removed by a user, said outlet tip will be removed to form an outlet opening through which controlled dispensing of said viscous food product from said hollow internal chamber via said angled internal walls will occur, so as to enable said viscous food product held in said internal hollow chamber to be substantially completely dispensed through said outlet opening formed by the removed outlet tip.

8. The dispenser pouch of claim 7 wherein said openings are in a flattened area of said dispenser pouch formed above said angled internal walls and between said specifically formed outlet spout portion and said perforations.

9. The dispenser pouch of claim 8 wherein said angled internal walls are at angles of approximately 15 degrees with respect to said substantially straight side seals.

10. The dispenser pouch of claim 8 wherein said sloped internal wall portions forming said funnel-shaped interior area are sloped at an angle of approximately 30 degrees with respect to a centerline of said dispenser pouch, which centerline is disposed parallel to said substantially straight side seals and passes centrally through said dispenser pouch and the outlet spout portion.

11. The dispenser pouch of claim 10, further including a substantially smooth, rounded edge formed between said angled internal walls and said funnel-shaped interior area.

12. The dispenser pouch of claim 11 wherein said hollow internal chamber of said dispenser pouch carries between 24 and 30 liquid ounces of said viscous product.

13. A collapsible, sanitary dispenser pouch formed from thin films of sheet material for holding between 24 and 30 liquid ounces of viscous product, comprising in combination:

a pair of substantially rectangular heat sealable films having two ends and two sides, heat sealed together along said two sides by substantially straight side seals;

a first of said two ends being heat sealed together so as to form a bottom, substantially straight cross seal;

a portion of the other of said two ends being heat sealed together so as to form a top cross seal having a specifically formed sealed outlet spout portion therein centrally disposed between said substantially straight side seals;

a hollow internal chamber formed between said substantially straight side seals, said bottom substantially straight cross seal and said top cross seal to hold said between 24 and 30 liquid ounces of viscous product therein;

said top cross seal including sealed portions formed between said pair of substantially rectangular heat sealable films adjacent to and angularly disposed between said specifically formed sealed outlet spout portion and said substantially straight side seals to form angled internal walls in said hollow internal chamber extending at angles of approximately 15 degrees with respect to said substantially straight side seals;

said specifically formed sealed outlet spout portion including an outlet tip and sloped internal wall portions which are sloped at an angle of approximately 30 degrees with respect to a centerline of said dispenser pouch, which centerline is disposed parallel to said substantially straight side seals and passes centrally through said dispenser pouch, to form a funnel-shaped interior area in said specifically formed sealed outlet spout portion;

a substantially smooth, rounded edge formed between said angled internal walls and said funnel-shaped interior area;

a pair of openings formed in and passing through said pair of substantially rectangular heat sealable films in a flattened area of said dispenser pouch formed above said sloped internal wall portions and between said specifically formed sealed outlet spout portion and perforations of a tear-off strip, away from said hollow internal chamber, toward said other of said two ends; and said tear-off strip being formed in said other of said two ends, away from said hollow internal chamber, above said pair of openings, by a plurality of perforations formed therein and extending across said other of said two ends, up to but not across said outlet tip of said specifically formed sealed outlet spout portion, which tear-off strip, when removed will also remove said outlet tip to unseal said specifically formed sealed outlet spout portion and allow controlled dispensing therethrough of said between 24 and 30 liquid ounces of viscous product from said hollow internal chamber, around said substantially smooth, rounded edge and out through said funnel-shaped interior area.

* * * * *